US006067838A

United States Patent [19]

Kameda et al.

[11] Patent Number: 6,067,838

[45] Date of Patent: May 30, 2000

[54] METHOD OF FORGING ROD-SHAPED WORK

[75] Inventors: Teruki Kameda, Kariya; Takeshi Inada, Tokai, both of Japan

[73] Assignee: Toyota Jidosha Kabushiki Kaisha, Toyota, Japan

[21] Appl. No.: 09/100,122

[22] Filed: Jun. 19, 1998

[51] Int. Cl.[7] ..... B21K 1/44

[52] U.S. Cl. ..... 72/371; 72/377

[58] Field of Search ..... 72/371, 377, 354.6, 72/354.8, 355.6, 356, 357, 359, 299, 302; 470/11

[56] References Cited

U.S. PATENT DOCUMENTS

| | | | |
|---|---|---|---|
| 1,069,659 | 8/1913 | Ferry | 470/11 |
| 1,427,521 | 8/1922 | Clouse | 72/357 |
| 3,289,229 | 12/1966 | Friedman | 72/359 |
| 4,607,515 | 8/1986 | Goodfellow | 72/377 |
| 4,970,887 | 11/1990 | Lorieux | 72/377 |

FOREIGN PATENT DOCUMENTS

| | | |
|---|---|---|
| 58-147643 | 10/1983 | Japan . |
| 7-1068 | 1/1995 | Japan . |

OTHER PUBLICATIONS

"Press Working Guide," p. 543, edited by Japan Plastic Work Society and published by Maruzen, Co., Ltd. on Oct. 25, 1975.

*Primary Examiner*—Lowell A. Larson
*Attorney, Agent, or Firm*—Burns, Doane, Swecker & Mathis, LLP

[57] ABSTRACT

A rod-shaped work made of metal is set into a forging die having a cavity where a load is applied to the rod-shaped work in the axial direction thereof and a twist is generated therein during an upset forging process so that an expanded portion is formed. This makes it possible to prevent generation of an underfill portion in the expanded portion which cannot be removed by a drawing process.

19 Claims, 7 Drawing Sheets

1
D1

10c
12
2.4xD10
10
L1
10a
11
D10

1
16
15c
15
15a

19

L1
F1
30
33
3
31
D1
Start
1A
10
1B
1
Final Stage

Start
Final Stage
50
5
55
1
12
10c
10a
52
16
15c
57
10
L2
D2
56

METHOD OF FORGING ROD-SHAPED WORK

FIELD OF THE INVENTION

The present invention relates to a method of forging a rod-shaped work so as to manufacture a product having an expanded portion in at least an axial portion thereof.

BACKGROUND OF THE INVENTION

A method of forging a rod-shaped work includes a known method of forming an expanded portion in at least an axial-directional portion of a metal rod- shaped work by an upset forging process. The "rod-shaped work" is defined as a rod-shaped member which is molded by an upset forging process.

The foregoing conventional method has steps of setting a rod-shaped work into a forging die, applying a load to the rod-shaped work in an axial direction thereof and charging a material of the rod-shaped work into an expanding cavity of the forging die so that an upset forging process is performed, by which an expanded portion is formed in an axial-directional portion of the rod-shaped work.

In Japanese Utility-Model Laid-Open No. 58-147643 and Japanese Patent Laid-Open No. 7-1068, methods have been disclosed with which an upset forging process is performed to manufacture a plastic-region clamping bolt which is also called a tension bolt.

When an expanded portion is formed by upset-forging a rod-shaped work, a deep underfill portion is sometimes generated in the expanded portion. The deep underfill portion is generated in the expanded portion where the work-forming material has not sufficiently filled the expanded cavity of the forging die. Since the molding load required to charge the work-forming material is increased in proportion to the upsetting length in the axial direction of the rod-shaped work, the frequency of generation of the deep underfill portions, which cannot be removed by a post-process, such as a drawing or ironing process is increased.

The molding load required to charge the work-forming material for the work is increased in proportion to an upsetting ratio (upsetting diameter after the upsetting/diameter of the material before the upsetting). Therefore, the frequency of generation of the deep underfill portions, which cannot be removed by a post-process, is increased.

The reason why the deep underfill portion, which cannot be removed by a post-process, is generated will now be described in reference to a conventional example for upset-forging a usual rod-shaped work. As schematically shown in FIGS. 9*a* and 9*b*, a rod-shaped work 1 is buckled into a wedge shape as the rod- shaped work 1 is compressed. Thereafter, further wedge-shape buckling proceeds. It is noted that FIGS. 9*a* and 9*b* are based on the drawing of "Press Working Guide", p.p. 543, edited by Japan Plastic Work Society and published by Maruzen, Co., Ltd. on Oct. 25, 1975.

Increasing the molding load is an effective way to prevent generation of the deep underfill portion. If the molding load is too high, however, the forging die can easily be broken. Therefore, in the actual operation, generation of the deep underfill portion is permitted to some extent. The generated deep underfill, if any, is judged as a defect that must be removed in a post-process. Thus, rather than increasing the molding load to prevent generation of the deep underfill, the molding load is kept low to ensure a long service life of the forging die, even though this results in deep underfills that form defective parts.

SUMMARY OF THE INVENTION

In view of the foregoing, an object of the present invention is to provide a method of forging a rod-shaped work with which generation of a deep underfill portion can satisfactorily be prevented.

To achieve the above-mentioned object, research and development have been performed by the inventor of the present invention. This research and development has illustrated that generation of a twist in a rod-shaped work, when an operation for upset-forging the rod-shaped is performed, satisfactorily prevents a deep underfill portion. As described further below, this result was confirmed by performing experiments.

Although all the reasons why the deep underfill portion can satisfactorily be prevented with the present invention have not been detected completely, it is generally understood that the twist improves the shearing deformability of the rod-shaped work, improving the forging characteristics.

According to one aspect of the present invention, there is provided a method of forging a rod-shaped work in which an expanded portion is formed in at least a portion of a rod-shaped work made of metal by an upset forging process. The method includes the steps of setting a rod-shaped work into a forging die having a cavity, causing the rod-shaped work to generate twisting force by applying a load thereto in an axial direction thereof, and forming an expanded portion in the rod-shaped work by charging a material for the rod-shaped work into the cavity of the forging die.

As a result, a twisted portion is generated in the rod-shaped work when the upset forging process for forming an expanded portion is performed. Thus, wedge-shape buckling of the rod-shaped work with which a deep underfill can easily be generated can be prevented. Moreover, a high molding load for preventing generation of the underfill portion is not required. Therefore, the required molding load does not have to be increased, thus preventing damage to the upset forging die. Accordingly, the service life of the upset forging die can be elongated and its size can be reduced. Moreover, the upset forging die can be manufactured using inexpensive material. Since the molding load does not have to be increased, no further rigidity is necessary for the forging apparatus. Therefore, the cost of the forging facilities can be reduced and space can be saved.

Since the method according to the present invention is able to prevent generation of a deep underfill portion, generation of a deep underfill portion can be prevented even if the upsetting ratio (diameter after an upsetting process/diameter before the upsetting process) is increased. For example, if the upsetting ratio is caused to approach the value 2, which has been considered difficult for a cold upset forging process for an alloy steel material, generation of the deep underfill portion can be prevented.

In the present invention, a step for drawing the outer surface of the expanded portion of the rod-shaped work may be added. As a result, even if a small underfill portion is generated, the underfill portion can be reduced by the drawing process.

DESCRIPTION OF THE PREFERRED EMBODIMENT

Figures 1A, 1B, 1C, 1D:
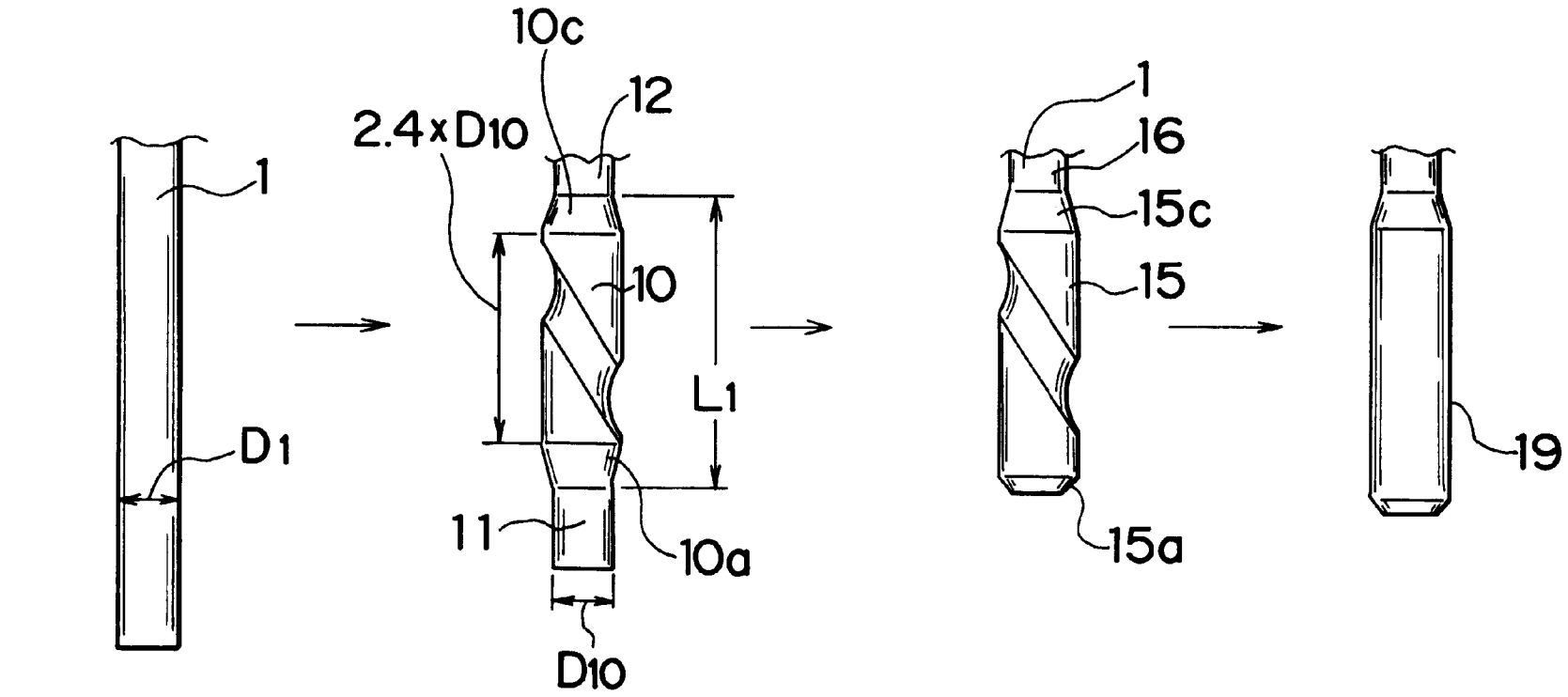
FIGS. 1*a*–1*d* are schematic view showing a process of a rod-shaped work according to an embodiment of the present invention.

Referring to the drawings, an embodiment of the present invention will now be described.

In this embodiment, a method of forging a rod-shaped work according to the present invention is applied to a cold upset forging process. FIGS. 1*a* to 1*d* correspond to the sequential order of the molding process. Initially, a rod-shaped piece or work 1 (diameter: D1) having substantially the same diameter throughout the length thereof is used. In general, the material of the cylindrical rod-shaped work 1 may be an alloy steel material or a carbon steel material. The material is not limited to this. The rod-shaped work 1 has a circular cross section.

As can be understood from FIG. 1*b,* the rod-shaped work 1 is compressed in the axial direction in a first upset forging step. Moreover, the work-forming material is expanded in the radial direction so that a first expanded portion 10 is formed in a portion of the rod-shaped work 1 in the axial direction of the rod-shaped work 1. The first expanded portion 10 has a conical-surface portion 10*a* at an end thereof and a conical-surface portion 10*c* at another end thereof. The first expanded portion 10 has a circular cross section. A small-diameter-shaft portion 11 having a diameter smaller than that of the first expanded portion 10 extends from the conical-surface portion 10*a* of the first expanded portion 10. A small-diameter-shaft portion 12 having a diameter smaller than that of the first expanded portion 10 extends from the conical-surface portion 10*c*.

The rod-shaped work 1, after being subjected to the first upset forging process, is then subjected to a second upset forging process so that the rod-shaped work 1 is compressed in the axial direction. Thus, a second expanded portion 15 is formed in the rod-shaped work 1 as shown in FIG. 1*c*. The second expanded portion 15 has conical-surface portions 15*a* and 15*c*. The second expanded portion 15 has a circular cross section. A small-diameter shaft portion 16 having a diameter smaller than that of the second expanded portion 15 extends from the conical-surface portion 15*c* of the second expanded portion 15. The diameter of each of the small-diameter shaft portions 16, 12 and 11 is basically the same as D1.

Then, as shown in FIG. 1*d,* the outer peripheral surface of the second expanded portion 15 is drawn in a drawing die so that the diameter of the second expanded portion 15 is reduced. Thus, a drawn surface 19 is formed. The amount of drawing can be set in the range from about 1% to about 5% of the diameter before the drawing process. For example, the diameter of the second expanded portion 15 may be reduced by 3% when it is drawn to define the drawn surface 19.

The drawing process improves the accuracy of the diameter of the second expanded portion 15 because any small underfill portion in the second expanded portion 15 may be removed during the drawing process. Even if a shallow underfill portion is generated in the second expanded portion 15, the underfill portion can advantageously be removed by drawing the second expanded portion. Therefore, it is preferable to determine the amount of drawing in accordance with the depth of the underfill portion. The second expanded portion 15 is preferably drawn enough to remove any underfill portion in the second expanded portion. However, because the present invention lessens the occurrence of deep underfill portions, it is not necessary to overly draw the second expanded portion.

Figures 2A, 2B, 2C:
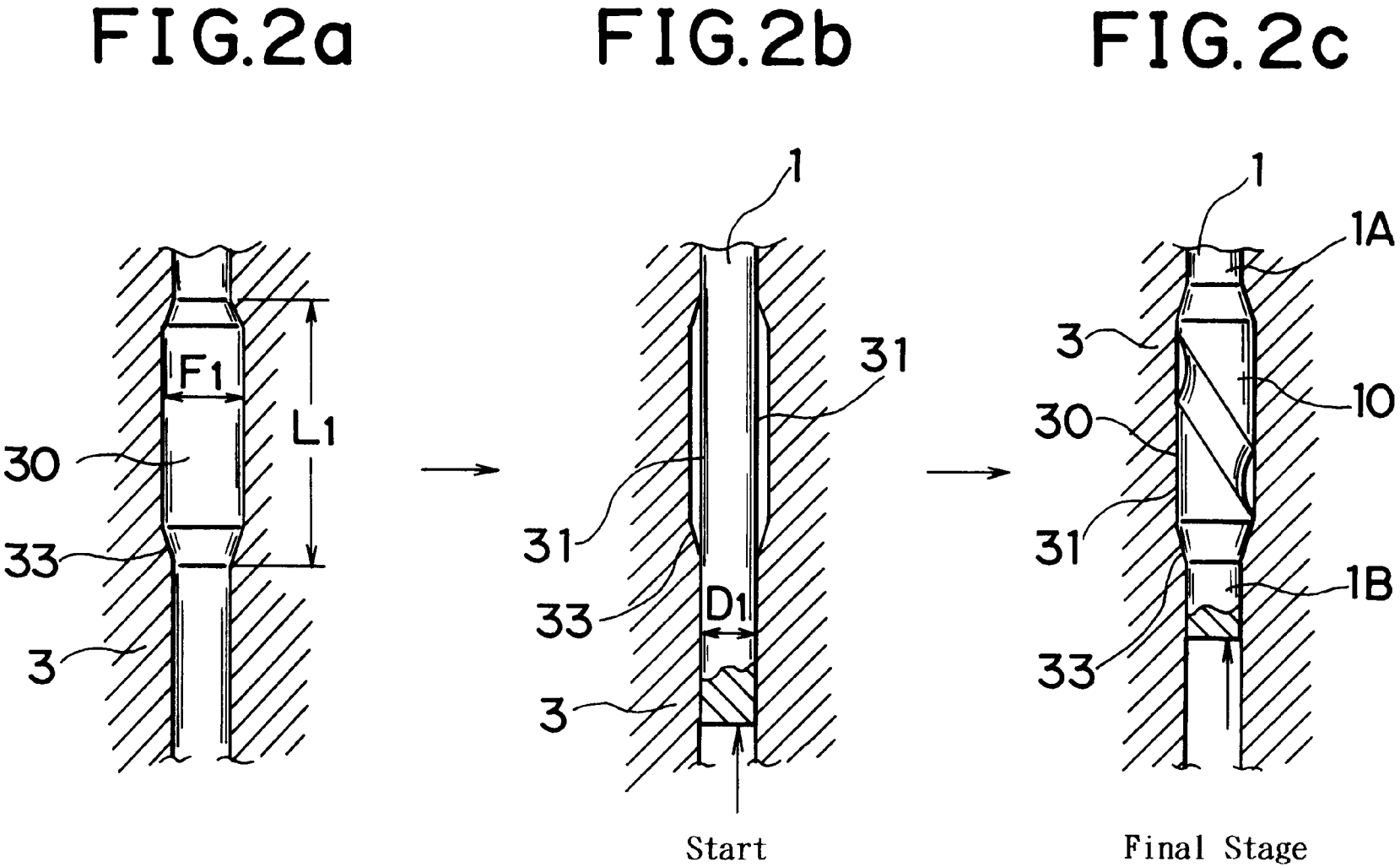
FIGS. 2*a*–2*c* are schematic view showing a first upset forging process using a first forging die.

The above-mentioned first upset forging process is shown in greater detail in FIGS. 2*a* to 2*c*. FIG. 2*a* shows a first forging die 3 where the rod-shaped work 1 is not loaded thereinto. FIG. 2*b* shows the first forging die 3 where the rod-shaped work 1 has been loaded for starting the first upset forging process. FIG. 2*c* represents a final stage of the first upset forging process.

As shown in FIG. 2*a,* the first forging die 3 has a first expansion cavity 30. The upsetting length of the first expansion cavity 30 of the first forging die 3 is indicated with L1, while the upsetting diameter defined by the inner diameter of the first expansion cavity 30 is indicated with F1. The upsetting length L1 is the length of the rod-shaped piece or work 1 that is caused to expand to a diameter greater than its original diameter D1. The upsetting diameter F1 also corresponds to the outer diameter of the first expanded portion 10. The method for preventing generation of a deep underfill portion permits the ratio of the upsetting length L1 to the diameter D1 (L1/D1) of the rod-shaped work 1 to be 3.7 or greater. For example, the value of L1/D1 can be set to be in the range from 3.7 to 7.

As described above, the molding load required to charge the work-forming material is typically increased in proportion to the upsetting ratio (upsetting diameter/initial material diameter or F1/D1). Therefore in accordance with conventional methods, an excessively high molding load is more likely to generate a deep underfill portion. That is, the conventional upset forging process tends to generate a deep underfill portion in the expanded portion as the value of F1/D1 approaches 1.8 or 2.0. The method according to the present invention is advantageous in that it allows the value of F1/D1 for the first forging die 3 to approach 1.8 or 2.0 while also minimizing the generation of a deep underfill portion, contrary to the conventional industrial upset forging process.

Namely, if the relationship F1/D1≧M is satisfied in the first upset forging process, the value of M can be set to a greater value, for example, 1.3, 1.5 or 1.8. As a matter of course, M may be set to 1.2 or smaller.

Figures 3A, 3B, 3C, 3D:
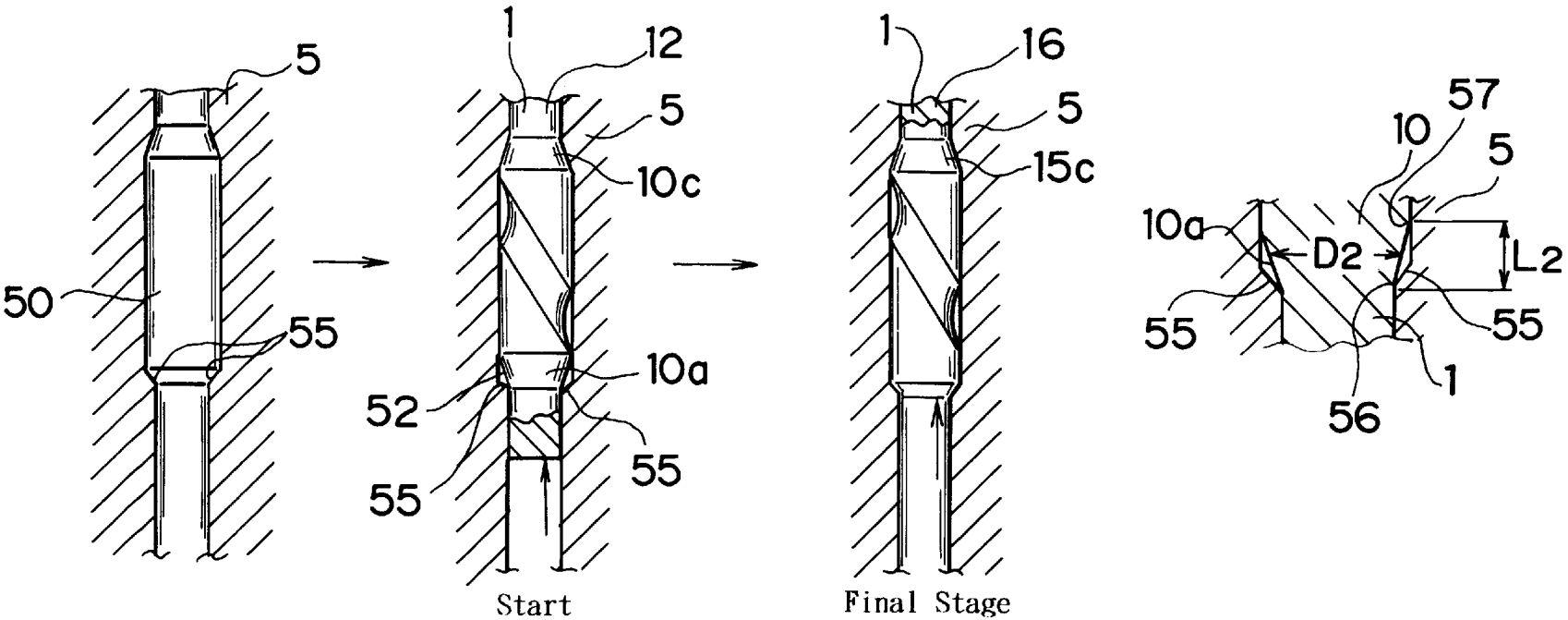
FIGS. 3*a*–3*d* are schematic view showing a second upset forging process using a second forging die.

The second upset forging process according to the present invention is shown in FIGS. 3*a* to 3*d*. FIG. 3*a* shows a second forging die 5 where the rod-shaped work 1 (already compressed by the first upset during process) is not loaded thereinto. As shown in FIG. 3*a,* the second forging die 5 has a second expansion cavity 50. FIG. 3*b* shows the forging die 5 where the rod-shaped work 1 has been loaded for starting the second upset forging process. FIG. 3*c* represents a final stage of the second upset forging process.

FIG. 3*d* shows an essential portion of FIG. 3*b*. FIG. 3*d* shows upsetting length L2 and the material diameter D2. The upsetting length L2 is the distance from a position 57 on the surface of the second forging die 5 at which the first expanded portion 10 of the rod-shaped work 1 is anchored to an end 56 of the small-diameter portion of a joint portion 55 of the second forging die 5. The joint portion 55 is a conical surface defining a taper from the end 56 to the expansion diameter of the expansion cavity 50. The diameter D2 is a mean value of the conical-surface portion 10*a* of the first expanded portion 10. In this embodiment, the value of L2/D2 is set to be 2.5 or smaller. For example, the value of L2/D2 is set to be in the range from 0 to 2.4.

When the first upset forging process is performed, the rod-shaped work 1 is loaded into the first forging die 3, as shown in FIG. 2*b*. At this time, an annular first clearance 31 is defined by the surface of the first expansion cavity 30 and the outer wall surface of the rod-shaped work 1.

Then, a load is applied to the rod-shaped work 1 by a first punching tool (not shown) in the axial direction of the rod-shaped work 1 by a first punching tool forging process is performed. The first upset forging process is performed such that the work-forming material is charged into the first expansion cavity 30 of the first forging die 3 and the first clearance 31 is filled with the work-forming material. Thus, a first expanded portion 10 is formed in a portion of the rod-shaped work 1 in the axial direction of the rod-shaped work 1. Then, the rod-shaped work 1 is separated from the first upset forging die 3.

As described further below, in this embodiment the first upset forging process causes the first expanded portion 10 of the rod-shaped work 1 to be twisted about the longitudinal axis of the rod-shaped work. For example, the first expanded portion 10 may be twisted to define a spiral portion.

The twists shown in FIGS. 2*c,* 1*b* and 1*c* are virtually illustrated. As a result of generation of the twist, the phase of an end 1A of the rod-shaped work 1 in the circumferential direction shown in FIG. 2*c* and the phase of the first expanded portion 10 in the circumferential direction are displaced from each other in the circumferential direction. Similarly, the phase of another end 1B of the rod-shaped work 1 in the circumferential direction shown in FIG. 2*c* and the phase of the first expanded portion 10 in the circumferential direction are displaced from each other in the circumferential direction. That is, the material in the expanded portion 10 between the ends 1A, 1B has been rotated about the longitudinal axis of the rod-shaped work 1. Thus, relative angular rotation occurs between the expanded portion 10 and either of the ends 1A, 1B about the longitudinal axis of the rod-shaped work 1.

It is assumed that the twist is generated in the following manner. FIG. 4 is a magnified view showing how the twist is generated. Circular arc P virtually indicates the surface of the first expansion cavity 30, line Px indicates X direction in the first expansion cavity 30 and Py indicates Y direction perpendicular to the X direction. Point A is an assumed position at which an upper portion of the rod- shaped work 1 is anchored by the first forging die 3, while point B is an assumed position at which a lower portion of the rod-shaped work 1 is anchored by the first forging die 3.

Figure 4A:
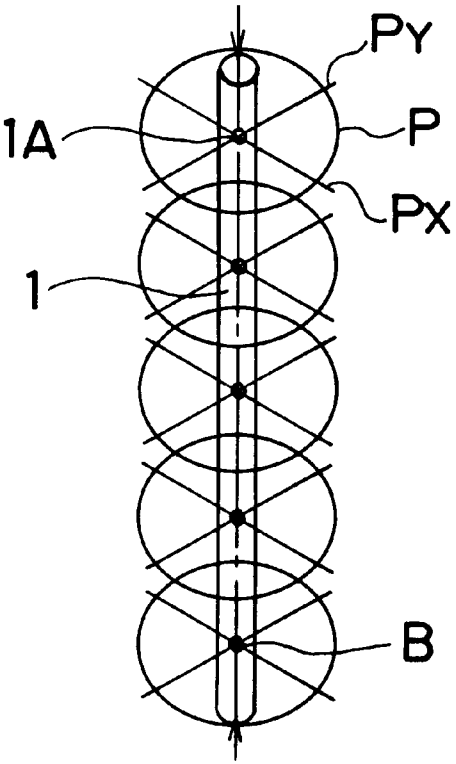
FIGS. 4*a*–4*c* are schematic view showing a process of generation of a twist in a rod-shaped work.
Figure 4B:
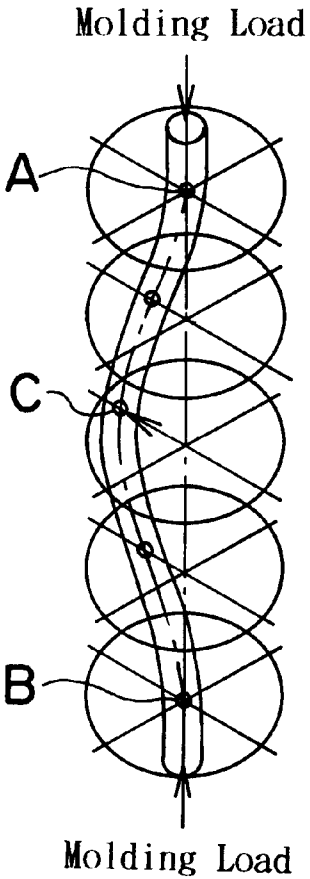
Figure 4C:
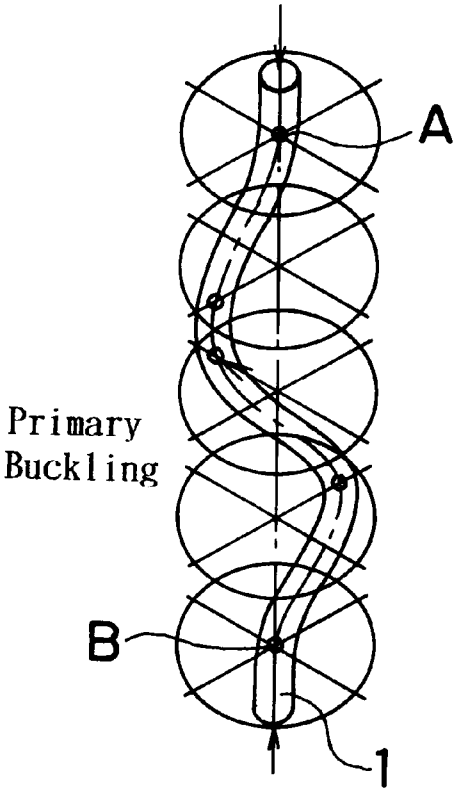

As shown in FIG. 4*a,* the rod-shaped work 1 prior to the first upset forging process extends straight and disposed at substantially the central position of the first expansion cavity 30 of the first upset forging die. In an initial stage of the first upset forging process, the forward movement of the punching tool (not shown) causes the rod-shaped work 1 to be primary-buckled, as shown in FIG. 4*b*.As a result, a portion of the rod-shaped work 1 is brought into contact with the surface of the first expansion cavity 30 in a state of point contact or near the state of point contact. It is assumed that the foregoing point of contact is a point C. Then, further movement of the punching tool causes the rod-shaped work 1 to be secondary-buckled as shown in FIG. 4*c*. Thus, the rod-shaped work 1 is twisted in the first expansion cavity 30.

It is noted that FIG. 4 shows a magnified state of the above-mentioned process for clear understanding. The actual clearance between the circular arc P which virtually indicates the surface of the first expansion cavity 30 and the outer surface of the rod-shaped work 1 in the direction Px and that in the direction Py are smaller than those illustrated.

Then, the rod-shaped work 1 having the first expanded portion 10, twisted by the first upset forging process described above, is loaded into the second forging die 5, as shown in FIG. 3*b*. In this state, an annular second clearance 52 is defined by the surface of the second expansion cavity 50 of the second upset forging die and the rod-shaped work 1, as shown in FIG. 3*b*.

Then, a load is applied to the rod-shaped work 1 in the axial direction of the rod-shaped work 1 by a second punching tool (not shown) so that the second clearance 52 is filled with the work-forming material. Then, the second upset forging process is performed. The second upset forging process is performed such that the work-forming material is charged into the second expansion cavity 50 of the second forging die 5 so that a second expanded portion 15 is formed at an axial-directional end of the rod-shaped work 1. With the method according to this embodiment, the diameter of the second expanded portion 15 subjected to the second upset forging process is slightly larger than the diameter of the first expanded portion 10 after the first upset forging process. However, design of the forging process may be performed such that the two diameters are substantially the same.

As a result of experiments performed by the inventor of the present invention it has been confirmed that it is possible to prevent generation of a deep underfill portion which cannot be removed by a subsequent drawing process if a twist is generated in the first expanded portion 10 of the rod-shaped work 1 by the first upset forging process. It is assumed that the reason why generation of the deep underfill portion can be prevented is that shearing deformation is likely to occur as the punching tool moves on because of the twist generated in the first expanded portion 10 of the rod-shaped work 1. Thus, the work-forming material can be easily plugged. Shearing deformation advantageously reduces molding resistance as compared with a process that simply compresses and deforms the rod-shaped work 1 in the axial direction thereof. Moreover, it can be considered that generation of the twist in the rod-shaped work 1 reduces the frictional force during the forging process as compared with the conventional process where buckling proceeds while keeping the rod-shaped work 1 wedge-shaped, causing friction against the surface of the first expansion cavity 30 of the first forging die 3. Supposing that the molding load acting on the rod-shaped work 1 is the same according to a process of the present invention and according to the conventional process, the rod-shaped work 1 having a twist improves efficiency for charging the work-forming material and the upset forging moldability. As a result, the process of the present invention it is more advantageous in that it minimizes generation of a deep underfill portion.

As can be understood from FIG. 2*a,* the first expansion cavity 30 of the first forging die 3 according to the present invention has a joint portion 33. The joint portion 33 has an inclined surface in the form of a cone having diameters that gently reduces toward an end of the upset portion. The experiments performed by the inventor of the present invention verify that an underfill portion can be generated easily as the length of the joint portion 33 increases. Meanwhile, the underfill portion cannot be generated easily as the length of the joint portion 33 decreases.

Figure 5B:
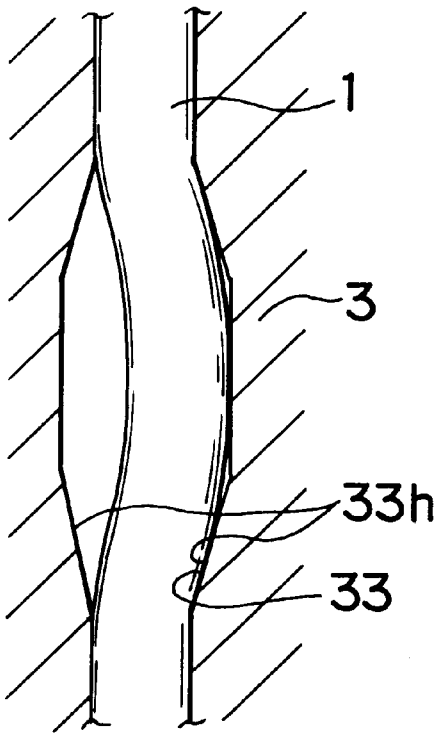
FIGS. 5*a* and 5*b* are schematic views showing the technical meaning of the length of a joint portion in the first forging die.
Figure 5A:
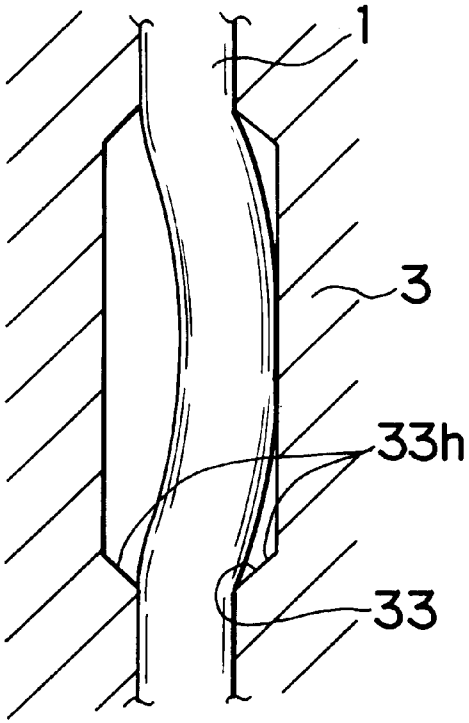

The reason for this will now be described hereinafter. FIG. 5*a* schematically shows a state where the joint portion 33 has a short length. FIG. 5*b* schematically shows a state where the joint portion 33 has a long length. As can be understood from FIG. 5*b,* the outer surface of the deformed rod-shaped work 1 can easily be brought into contact with a surface 33*h* of the joint portion 33 if the joint portion 33 has a long length. Thus, the frictional force between the surface 33*h* and the rod-shaped work 1 increases to further enhance resistance of the rod-shaped work 1 against twisting. As a result, it is difficult to generate a twist in the rod-shaped work 1.

On the other hand, if the joint portion 33 has a short length, the outer surface of the rod-shaped work 1 cannot easily be brought into contact with the surface 33*h,* as can be understood from FIG. 5*a*. The degree of contact decrease to further decrease the frictional force between the surface 33*h* and the rod-shaped work 1. As a result, the resistance of the rod-shaped work 1 against twisting can be reduced. Thus, the rod-shaped work 1 can be rotated easily and generation of a twist in the rod-shaped work 1 can be facilitated.

Therefore, the length l of the joint portion 33 in the axial direction, i.e., in the vertical direction, is an important factor for performing the first upset forging process. Under conditions for specifying the upset length L1 shown in FIG. 1*b,* it is preferable to set the length l of the joint portion 33 to be relatively short so as to make the axial length of the first expanded portion 10 to the diameter D10 of the rod-shaped work 1 to be equal to or more than 2.4×D10. That is, the length of the joint portion 33 to be $l \leqq L1-2.4 \times D10$. That is, it is preferable that the length l of the joint portion 33 be short enough to satisfy the equation $l \leqq L1-2.4 \times D10$.

Figure 6:
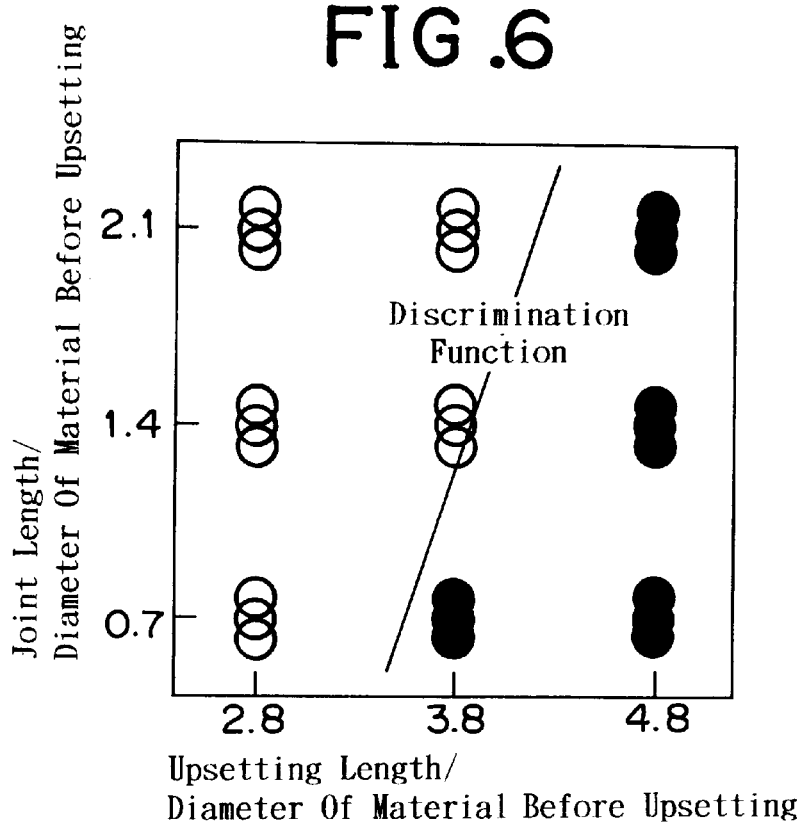
FIG. 6 is a graph showing the relationship between the length of an upsetting length and that of the joint portion.

Results of experiments of the length of the joint portion 33 in the first upset forging process performed by the inventor of the present invention are shown in FIG. 6. In FIG. 6, the axis of abscissa stands for the upset length and the axis of ordinate stands for the length of the joint portion 33. Black circular mark (●) indicates a state where a twist has been generated in the rod shaped work 1, while white circular mark (○) indicates a state where the rod-shaped work 1 has been buckled into the wedge shape as has been experienced with the conventional structure. A discrimination function for distinguishing the regions indicated with black marks (●) from the regions indicated with white marks (○) is expressed by Yk. Supposing that the upset length L1 in the upset forging process is indicated with α and the length of the joint portion 33 is indicated with γ, the discrimination function Yk is expressed by the following equation. It is noted that C1 and C2 are constants.

Discrimination Function $Yk=-(C1\times\alpha)+(C2\times\gamma)+\text{Initial Value}$ $Yk<0$: region where twist is generated $Yk>0$: region where wedge-shape portion is generated Since α has a negative sign as described above, the relationship $Yk<0$ can easily be satisfied and a twist can easily be generated in proportion to the value of α, that is, in proportion to the upset length L1 in the upset forging process. Thus, generation of the deep underfill portion can advantageously be prevented. Since γ in the above-mentioned equation has a positive sign, the relationship $Yk=0$ can easily be satisfied. Therefore, the wedge-shape buckling easily occurs and an underfill portion can easily be generated in proportion to the value of γ, that is, the length of the joint portion in the first upset forging process. The rod-shaped work 1 may be employed to manufacture a bolt, a shaft member, an elongated member or the like.

EXAMPLE

Figure 7:
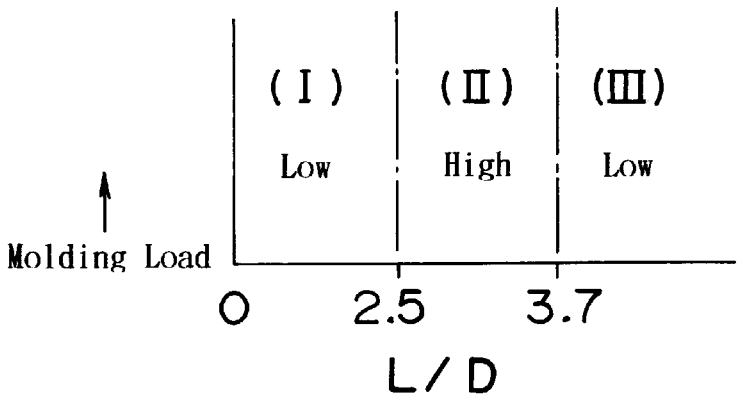
FIG. 7 is a diagram showing a generation relationship between L/D and a molding load in the upset forging process.

Since the molding load required to charge the work-forming material can be reduced if the L/D ratio in the upset forging process has a small value, it has been expected that the required molding load is increased if the L/D ratio increases. However, experiments performed by the inventor of the present invention indicate the general tendency shown in FIG. 7. That is, the molding load is decreased to a low value in a region (I) where L/D is small, i.e., where L/D is 2.5 or smaller. If L/D gradually increases, in a region (II) where L/D ranges from 2.5 to 3.7 (if the rod-shaped work 1 is formed into an elongated shape), the required molding load is considerably increased. If L/D further increases, in a region (III) where L/D ranges from 3.7 to 7, the required molding load decreases to be lower, against all probability, as compared with the state where L/D ranges from 2.5 to 3.7. The foregoing fact was found by the inventor of the present invention. Such phenomenon is assumed to be caused by the fact that the twist of the rod shaped work 1 considerably affects the upset forging characteristic.

Therefore, in the method according to the present invention, the upset forging process is performed by two steps. The first upset forging process is performed in the region (III) and the second upset forging process is performed in the region (I). Moreover, the upset forging process is not performed in the region (II).

Applicable Example

The above-mentioned method was applied to manufacture a plastic-region clamping bolt. The plastic-region clamping bolt is employed to clamp elements for an internal combustion engine or the like. Since the plastic-region clamping bolt uses yield stress, it is not susceptible to an influence of dispersion of the coefficients of friction between the shearing surface and a subject which must be clamped. Therefore, dispersion of the axial force can be prevented. Although an elastic-region clamping bolt has been generally used for the application, the plastic-region clamping bolt has recently been employed in a region requiring strong and reliable clamping to realize higher output of the internal combustion engine, improvement in the quality and weight reduction.

Figure 8:
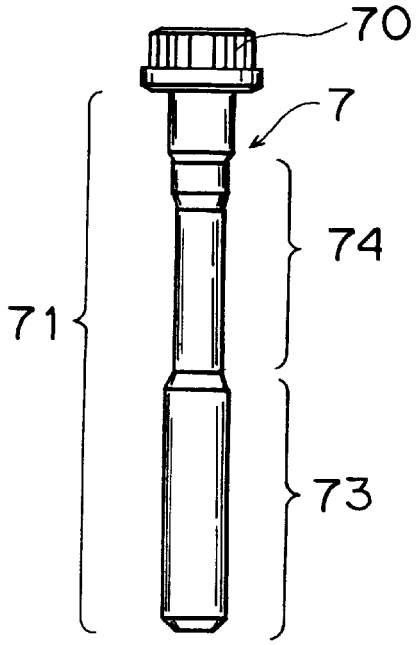
FIG. 8 is a side view showing a plastic-region clamping bolt manufactured by the method according to the embodiment of the present invention.
Figure 9A:
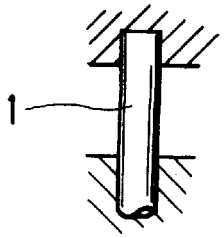
FIG.9 a RELATED ART
FIGS. 9*a* and 9*b* are schematic views showing a state of buckling occurring in a general upset forging process.
Figure 9B:
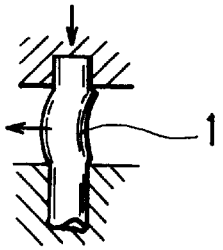
FIG.9 b RELATED ART

A plastic-region clamping bolt 7, as shown in FIG. 8, has a head 70 and a shaft 71. The shaft 71 has a thread portion 73 on which a male thread will be formed and a tension portion 74 formed between the head 70 and the thread portion 73. The thread portion 73 shown in FIG. 8 has no male thread portion formed thereon. The tension portion 74 is designed to have a small horizontal cross sectional area so that plastic deformation of the thread portion 73 is prevented. The tension portion 74 corresponds to the above-mentioned small-diameter shaft portion 16. The male thread portion can be formed on the outer peripheral surface of the thread portion 73 by a rolling mold.

The foregoing applicable example is able to form the tension portion 74 by the above-mentioned upset forging process without forming the same by a cutting work.

In the above-mentioned embodiment, the joint portion 33 is provided with the first expansion cavity 30 of the first forging die 3 as a result of the first upset forging process. The rod-shaped work can be twisted by adjusting the length of the joint portion 33. Another structure may be employed in which the punching tool is rotated for a predetermined angular degree in the circumferential direction when the punching tool is moved so as to transmit the twisting force to the rod-shaped work. Another structure may be employed in which twisting of the rod-shaped work 1 is enhanced. Alternatively, lubricant exhibiting a significant lubricating characteristic may be applied to the surface of the foregoing die so as to enhance twisting of the rod-shaped work.

In this embodiment, the upset forging process is performed at two stages, a first upset forging process and a second upset forging process. If the first expanded portion 10 twisted in the first upset forging is substantially free from an underfill portion or if the underfill has a small depth, the drawing process may be directly performed without performing the second upset forging process.

According to the present invention, the number of the upset forging operation may be one, or both of the first and second upset forging processes may be performed as described in the above-mentioned embodiment.

What is claimed is:

1. A method of forging a metal rod-shaped work by an upset forging process, comprising:

locating a metal rod-shaped piece having a first end portion, a second end portion, and a central portion located between said first end portion and said second end portion in a forging die cavity having an expansion portion possessing a diameter greater than a diameter of a remaining portion of said cavity such that said central portion of said rod-shaped piece is located in said expansion portion of said cavity and said first end portion and said second end portion are located in said remaining portion of said cavity;

holding radially said first end portion and said second end portion in said remaining portion of said cavity; and applying a load to said rod-shaped piece in an axial direction of said rod shaped piece to cause said central portion of said rod-shaped piece to twist and form an expanded portion in said expansion portion of said cavity while said first end portion and said second end portion remain located in said remaining portion of said cavity.

2. The method of forging a metal rod-shaped work according to claim 1, further comprising drawing an outer surface of the expanded portion.

3. The method of forging a metal rod-shaped work according to claim 1, wherein $L1/D \geqq 3.7$, where D is a diameter of said rod-shaped piece and L1 is an upsetting length of said rod-shaped work.

4. The method of forging a metal rod-shaped work according to claim 1, wherein a length l of a joint portion of said expansion portion satisfies $l \leqq L1-D\times 2.4$, where D is a diameter of said rod-shaped piece and L1 is an upsetting length of said rod-shaped work.

5. The method of forging a metal rod-shaped work according to claim 1, further comprising:

setting said forged rod-shaped work into a second forging die having an expansion cavity; and applying a second load to said rod-shaped work to further expand said expanded portion.

6. The method of forging a metal rod-shaped work according to claim 5, wherein $L2/D2 \leqq 2.5$, where D2 is a mean diameter of a conical surface portion of said forged rod-shaped work and L2 is an upsetting length of said forged rod-shaped work.

7. The method of forging a metal rod-shaped work according to claim 1, wherein said forging die cavity includes at least one joint portion that defines a transition between said expansion portion and said remaining portion of said forging die cavity.

8. The method of forging a metal rod-shaped work according to claim 1, wherein said remaining portion includes a first cylindrical portion and second cylindrical portion, said expansion portion being located between said first cylindrical portion and said second cylindrical portion.

9. The method of forging a metal rod-shaped work according to claim 8, wherein the load is applied to said rod-shaped piece in an axial direction of said rod-shaped piece to cause said rod-shaped piece to twist and form said expanded portion in said expansion portion of said cavity while said first end portion is located in said first cylindrical portion and while said second end portion is located in said second cylindrical portion of said capacity.

10. A method of forging a metal rod-shaped work, comprising:

locating a metal rod-shaped piece having a first end portion, a second end portion, and a central portion in a cavity of a forging die, said cavity having an expanded portion and a remaining portion, said expanded portion having a diameter greater than a diameter of said remaining portion of said cavity;

holding radially said first end portion and said second end portion in said remaining portion of said cavity; and compressing said metal rod-shaped piece in said cavity to cause said central portion of said metal rod-shaped piece to twist and expand in said expanded portion of said cavity without expanding said first end portion and said second end portion to form a metal rod-shaped work having an expanded portion.

11. The method of claim 10, further comprising secondarily compressing said formed rod-shaped work in a second cavity to further expand said compressed rod-shaped piece.

12. The method of claim 10, further comprising:

drawing said compressed rod-shaped piece to decrease an outer diameter of said expanded portion.

13. The method of claim 10, wherein said cavity includes at least one joint portion that defines a transition between said expansion portion of said cavity and said another portion of said cavity.

14. A forging die for forging a metal rod-shaped work, comprising:

a cavity having an expansion portion possessing a diameter greater than a diameter of a remaining portion of said cavity; and means for causing a central portion of a metal rod-shaped piece located in said expansion portion of said cavity to twist and expand when an axial load is applied to the metal rod-shaped piece without expanding opposite end portions of said metal rod-shaped piece, said means for causing twist comprising means for holding radially said opposite end portions in said remaining portion of said cavity.

15. The forging die according to claim 14, wherein said expansion portion of said cavity includes a conical surface defining a taper to an expansion diameter of said expansion portion, and said twisting means includes a length l of said conical surface satisfying $l \leqq L-2.4\times D$, where D is a rod diameter of the metal rod-shaped piece and L is an upsetting length of the metal rod-shaped work to be forged.

16. The forging die according to claim 14, wherein said cavity includes at least one joint portion that defines an transition between said expansion portion of said cavity and said remaining portion of said cavity.

17. The forging die according to claim 16, wherein said remaining portion include a first cylindrical portion and a second cylindrical portion, said expansion portion being located between said first cylindrical portion and said second cylindrical portion.

18. A metal rod-shaped work having an expanded portion formed by the process of:

locating a metal rod-shaped piece having a central portion located between opposing end portions of said rod-shaped piece in a cavity of a forging die, said cavity having an expansion portion and a remaining portion, said expansion portion possessing a diameter greater than a diameter of said remaining portion of said cavity;

holding radially said opposing end portions in said remaining portion of said cavity; and compressing said metal rod-shaped piece in said cavity to cause only said central portion of said metal rod-shaped piece to twist and expand in said expansion portion to form said metal rod-shaped work.

19. The metal rod-shaped work according to claim 18, wherein said cavity further includes at least one joint portion that defines a transition between said expansion portion and said another portion of said cavity.

* * * * *